United States Patent [19]

Abbott

[11] 4,183,133

[45] Jan. 15, 1980

[54] HINGE PINTLE REMOVAL TOOL

[76] Inventor: Thomas R. Abbott, 1266 Richard St., Orange, Calif. 92669

[21] Appl. No.: 948,817

[22] Filed: Oct. 5, 1978

[51] Int. Cl.[2] ..... B25B 27/14

[52] U.S. Cl. ..... 29/275; 29/280

[58] Field of Search ..... 29/275, 276, 255, 280; 145/46; 81/52.35

[56] References Cited

U.S. PATENT DOCUMENTS

| | | | |
|---|---|---|---|
| 2,089,902 | 8/1937 | Kulp | 29/275 |
| 3,602,969 | 9/1971 | Provost | 29/275 |
| 3,689,977 | 9/1972 | Crabbe | 29/280 |

*Primary Examiner*—James L. Jones, Jr.
*Attorney, Agent, or Firm*—Fischer and Tachner

[57] ABSTRACT

A hand tool adapted to remove a pintle from a door hinge and comprising a curved hollow guide or shield within which is fixed a push rod adapted to force the pintle out of a door hinge when the tool is layed against the door hinge pintle and struck with a hammer. A removal wedge, fixed to the outside surface of the guide, provides a striking surface for removal of the tool in the event of a jam.

5 Claims, 5 Drawing Figures

HINGE PINTLE REMOVAL TOOL

BACKGROUND OF THE INVENTION

The present invention relates generally to hand tools and more particularly to a tool which is adapted to dislodge and remove a pintle from the aligned hinge knuckles of a butt-type door hinge.

Although hand tools adapted to loosen and remove a pintle from a door hinge are known in the prior art, such prior art tools rely upon the pintle having a head so that the head may be pried up and loosened before being thrust up to remove the pintle from the hinge. By way of example, see U.S. Pat. No. 3,602,969 to Provost. Unfortunately, hinge pintles that do not have a head cannot be removed with such prior art tools. One alternative is to use a bare push rod to direct upward thrusting blows to the bottom end of a hinge pintle. However, a bare push rod may easily slip or glance off the bottom end of the pintle, resulting in either damage to the door or frame or injury to the user. Bare push rods that may be used to thrust the hinge pintle up out of the hinge suffer from an additional disadvantage which is readily overcome by the present invention as will be seen hereinafter. This disadvantage is that subsequent to insertion of the push rod into the cylindrical hollow formerly occupied by the pintle, which results in removal of the pintle, the push rod often becomes jammed in the hinge hollow in place of the pintle and can be removed only with great difficulty, if at all. Such jamming or binding often leaves the user with more of a problem than removal of the pintle.

SUMMARY OF THE INVENTION

The present invention overcomes the inadequacies of prior art hand tools of the type above described by providing a push rod device for thrusting a pintle up through the hinge so that it may be used with hinge pintles having no head, as well as with hinge pintles that do have such a head. In addition, the novel construction of the present invention precludes the dangers of damage and injury of a bare push rod by providing a hollow guide or shield which locates and secures the push rod into optimum position with the hinge pintle prior to the application of upwardly thrusting blows by means such as a hammer and the like. In addition, the present invention provides means for overcoming the aforementioned jamming problem of bare push rods by providing a removal wedge which is fixed to the outside of the guide to provide a striking surface upon which downward thrusting force can be applied by means of a hammer and the like for the removal of the tool in the event of binding between the tool push rod and the inside cylindrical hollow of the hinge from which the pintle has been removed.

Thus it is an object of the present invention to provide a hand tool for removal of hinge pintles, but which substantially overcomes the disadvantages of the prior art.

It is another object of the present invention to provide a hinge pintle removal tool which is adapted to remove such pintles whether or not they have a head.

It is still a further object of the present invention to provide a hinge pintle removal tool which provides a push rod for thrusting pintles up out of the hinge but which accomplishes such removal with substantially less liklihood of damage and injury.

It is still a further object of the present invention to provide a hinge pintle removal tool which is itself readily removable from the hinge subsequent to pintle removal, despite the possible binding of the tool in the hinge that might otherwise preclude easy removal of the tool.

BRIEF DESCRIPTION OF THE DRAWINGS

Other objects and advantages of the present invention will become apparent from the following detailed description when considered in conjunction with the accompanying drawings in which.

DETAILED DESCRIPTION OF THE INVENTION

Figure 1:
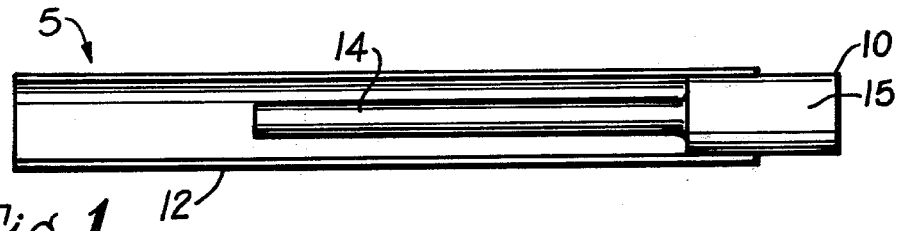
FIG. 1 is a top plane view of the invention.
Figure 2:
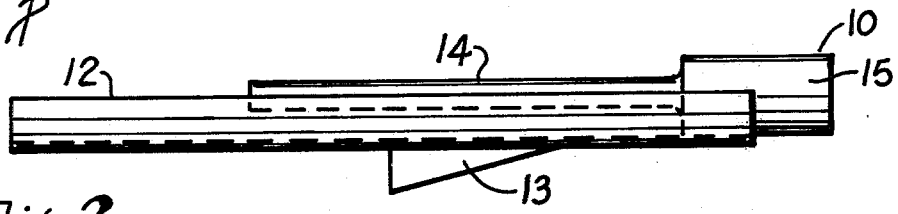
FIG. 2 is a front plane view of the invention.
Figure 3:
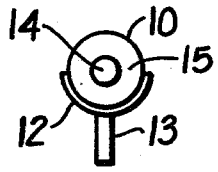
FIG. 3 is a side plane view of the invention.

Referring now to FIGS. 1, 2 and 3, there is shown therein three different views of the hand tool comprising the present invention; namely, a hinge pintle remover 5 comprising a push rod 10 having a base 15 and a pin 14, a shield or guide 12 of fractionally circular cross-section, and a removal wedge 13.

The base 15 and pin 14 of push rod 10 are each cylinders of circular cross-section and are collinearly located along a common axis. In one embodiment, base 15 has a cross-section of approximately 7/16 inches and a length of approximately 1 inch, and pin 14 has a cross-section of approximately 3/16 inches and a length of approximately 2 and $\frac{7}{8}$ inches. In that same embodiment, push rod 10 is a unitary element of the invention, with the cross-section of the pin 14 having been reduced in dimension with respect to base 15 by appropriate tooling such as a lathe.

In any case, the pin 14 is of appropriate cross-section and length to be insertable within the hollow or cavity in which the hinge pintle is located to force the pintle up out of the hinge to a sufficient degree to permit easy removal of the hinge pintle thereafter.

Shield or guide 12 comprises a segment of still an additonal circular cylinder, and is roughly a one-third segment of a hollow circular cylinder having an inner radius approximately equal to the radius of base 15 and an outer radius of approximately $\frac{1}{4}$ inches. Shield or guide 12 is permanently affixed to the outside surface of base 15 starting at about $\frac{1}{3}$ of the distance from the free end of base 15 and is located coaxially with respect to both base 15 and pin 14. In the illustrated embodiment, shield or guide 12 is approximately 5 inches in length and, therefore, extends beyond the free end of pin 14 by slightly more than 1 and $\frac{1}{2}$ inches. Shield or guide 12 may be affixed to the base 15 by welding and the like.

As a result of the manner in which the three pieces of the hand tool, namely, the shield or guide 12, pin 14, and base 15 are located around a common axis in a concentric fashion, a gap exists between pin 14 and shield or guide 12 which is best seen in cross-section in FIG. 3. It will be seen hereinafter in conjunction with a discussion of FIGS. 4 and 5, that the cylindrical gap between shield or guide 12 and pin 14 permits the shield or guide to be placed around the outer peripheral surface of the knuckles of a hinge and to slip over that surface as the push rod 10 of the invention is thrust up into the concentrically located hollow or cavity of the hinge to engage the pintle and push the pintle up and out of the hinge for easy removal therefrom.

Figure 4:
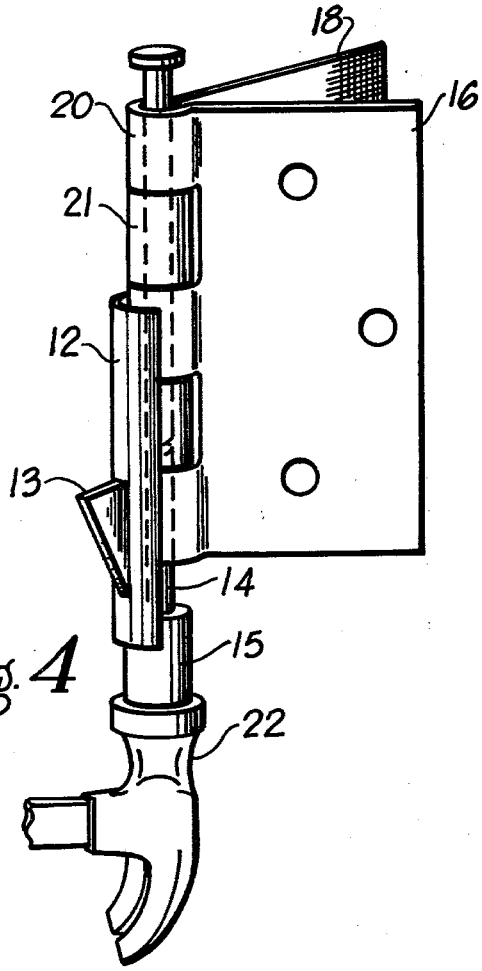
FIG. 4 is an isometrical view of the invention shown in conjunction with a butt-type hinge and in an appropriate position for removal of the hinge pintle.
Figure 5:
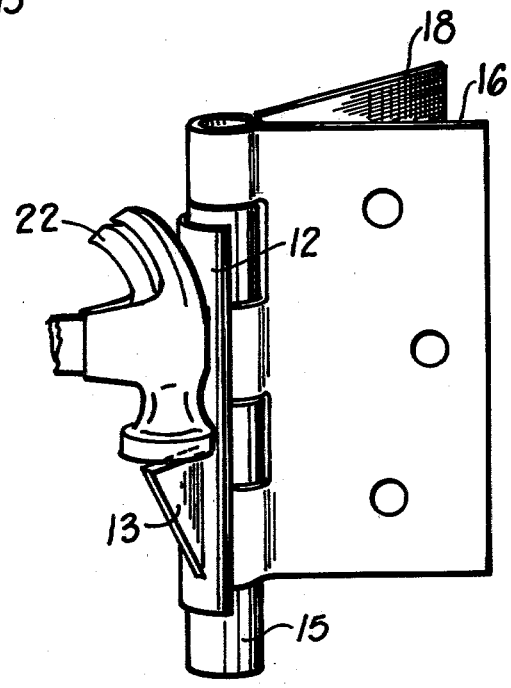
FIG. 5 is an isometrical view of the invention similar to that of FIG. 4 but shown with the hinge pintle previously removed and with the invention in position for its ready removal from the hinge.

The operation of the hinge pintle removal tool of the present invention may be best understood by reference to FIGS. 4 and 5. FIG. 4 shows the invention in position for removal of the hinge pintle with the push rod 14 being placed below and in collinear contiguous relation with pintle 20. As shown in FIG. 4, with pin 14 of push rod 10 located in this position, the shield or guide 12 of the tool 5 partially circumscribes the exterior periphery of the circular surface 21 of the abutting and connected hinge plates 16 and 18, respectively. In this position, the hinge pintle removal tool 5 may then be subjected to upward thrusting force such as by the impact of a hammer 22, so that the free end of pin 14 impacts the lower end of pintle 20 and forces it up and out of the hinge. As the pintle moves upwardly, the tool does likewise with pin 14 taking the place of the pintle and the shield or guide 12 also moving up along the outer peripheral surface 21 of the hinge. During this upward thrusting motion of the removal tool 5, the circular portion 21 of the hinge plates 16 and 18, fills the gap between shield 12 and pin 14 previously referred to in conjunction with FIG. 3. Ultimately, with sufficient blows from the hammer 22, the pintle is raised out of the hinge to a sufficient degree to enable easy removal of the pintle. It is at this pointin the process of the pintle removal, that one may encounter the potential problem of a binding or jamming or pin 14 within the hinge. This condition is represented in FIG. 5 in which it is shown that the pintle has been removed from the hinge and tool 5 is fully inserted within the hinge hollow formerly occupied by the pintle. At this point, hammer 22 may be used to apply downwardly thrusting blows to the top surface of wedge 13, thereby forcing the tool in a downward direction and overcoming the potential binding or jamming to remove the tool from the hinge.

It will now be understood that what has been disclosed herein is a hand tool suitable for removing pintles, with or without heads, from butt-type hinges. In addition, the present invention provides means for removal of the tool itself in case of binding or jamming of the tool within the hollow of the hinge after the pintle is removed.

Although a specific embodiment of the invention has been disclosed herein, it will now be apparent to those having ordinary skill in the art to which the invention pertains, that many other embodiments of the invention may be constructed. For example, in view of applicant's teaching herein disclosed, it will now be apparent that there may be variations in dimensions and basic design that would permit substantial deviation from the specific configuration disclosed herein by way of example. Illustrative of such variations is the use of alternative dimensions and methods of affixing the respective elements comprising the invention. Accordingly, the invention is not to be limited except as defined by the appended claims.

I claim:

1. A hinge pintle removal tool comprising:

a. a push rod having a pin connected at one end to a base, said base having a larger cross-section than said pin and having a free end adapted to receive blows from a blunt object to advance said push rod into said hinge, said pin having a free end with a cross-section adapted for insertion into the hollow of a hinge for displacement of the hinge pintle; and b. an elongated shield affixed along a portion thereof to said push rod at said base, said shield being adapted to partially overlie the circular periphery of a hinge when said pin is inserted in said hollow.

2. A hinge pintle removal tool as defined in claim 1, further comprising:

a removal device affixed to said shield and adapted to receive blows from a blunt object to force said push rod out of said hinge for removing said tool from said hinge.

3. A hinge pintle removal tool as defined in claim 1, in which said pin and said base are collinearly aligned circular cylinders and wherein said elongated shield is a segment of a hollow circular cylinder having an inner radius substantially equal to radius of said base.

4. A hinge pintle removal tool comprising:

a. a push rod having a pin connected at one end to a base, said base having a larger cross-section than said pin and having a free end adapted to receive blows from a blunt object to advance said push rod into said hinge, said pin having a free end with a cross-section adapted for insertion into the hollow of the hinge for displacement of the hinge pintle;

b. an elongated shield affixed along a portion thereof to said push rod at said base, said shield being adapted to partially overlie the circular periphery of a hinge knuckle when said pin is inserted in said hollow;

c. said pin and said base being collinearly aligned circular cylinders and said elongated shield being a segment of a hollow circular cylinder having an inner radius substantially equal to the radius of said base; and d. a removal device affixed to said shield and adapted to receive blows from a blunt object to force said push rod out of said hinge for removing said tool from said hinge.

5. A hinge pintle removal tool as defined in claim 4, wherein said removal device comprises a wedge having at least one substantially horizontal surface for receiving said blows from said blunt object.

* * * * *